US006467261B2

(12) United States Patent
Hisanaga et al.

(10) Patent No.: US 6,467,261 B2
(45) Date of Patent: Oct. 22, 2002

(54) DOUBLE EXHAUST PIPE FOR ENGINE

(75) Inventors: Toru Hisanaga; Hiroshi Shinmura; Kazuhiro Furuhashi; Yasuyuki Sakurai, all of Hamamatsu (JP)

(73) Assignee: Yutaka Giken Co., Ltd., Shizuoka (JP)

( * ) Notice: Subject to any disclaimer, the term of this patent is extended or adjusted under 35 U.S.C. 154(b) by 0 days.

(21) Appl. No.: 09/748,117

(22) Filed: Dec. 27, 2000

(65) Prior Publication Data

US 2001/0032460 A1 Oct. 25, 2001

(30) Foreign Application Priority Data

Dec. 28, 1999 (JP) ..... 11-375015

(51) Int. Cl.[7] ..... F01N 7/10

(52) U.S. Cl. ..... 60/323; 60/322; 138/112; 138/177

(58) Field of Search ..... 60/322, 323, 272, 60/282, 313; 138/112, 113, 114, 177

(56) References Cited

U.S. PATENT DOCUMENTS 4,856,822 A * 8/1989 Parker ..... 285/62
5,606,857 A * 3/1997 Harada ..... 60/322
5,761,905 A * 6/1998 Yamada et al. ..... 60/322
5,907,134 A * 5/1999 Nording et al. ..... 181/228
5,953,912 A * 9/1999 Kaiho et al. ..... 60/323
5,988,308 A * 11/1999 Qutub ..... 180/309

FOREIGN PATENT DOCUMENTS

JP 2-40249 10/1990

* cited by examiner

*Primary Examiner*—Thomas Denion
*Assistant Examiner*—Binh Tran
(74) *Attorney, Agent, or Firm*—Arent Fox Kintner Plotkin & Kahn

(57) ABSTRACT

A double exhaust pipe for an engine includes an inner pipe shell, and an outer pipe shell in which the inner pipe shell is accommodated. The inner pipe shell is secured at one end thereof to the outer pipe shell and slidably fitted at the other end thereof to an inner peripheral surface of the outer pipe shell. A heat-insulating space is provided between the inner and outer pipe shells to extend from the one end to the other end of the inner pipe shell. In this double exhaust pipe, the inner pipe shell has a bulged portion formed at the other end thereof. The bulged portion has a spherical outer surface slidably and oscillatably fitted to an inner peripheral surface of the outer pipe shell. Thus, even if the free end of the inner pipe shell is inclined upon thermal elongation of the inner pipe shell, the bulged portion at the free end can always be smoothly slipped on the inner peripheral surface of the outer pipe shell.

6 Claims, 5 Drawing Sheets

DOUBLE EXHAUST PIPE FOR ENGINE

BACKGROUND OF THE INVENTION

1. Field of the Invention

The present invention relates to a double exhaust pipe for an engine, and in particular, to an improvement of a double exhaust pipe for an engine, comprising an inner pipe shell, an outer pipe shell in which the inner pipe shell is accommodated, the inner pipe shell being secured at one end thereof to the outer pipe shell and slidably fitted at the other end to an inner peripheral surface of the outer pipe shell, and a heat-insulating space provided between the inner and outer pipe shells to extend from the one end to the other end of the inner pipe shell.

2. Description of the Related Art

There is such a double exhaust pipe for an engine, as disclosed, for example, in Japanese Utility Model Publication No. 2-40249 wherein a bulged portion is formed at the other end of an inner pipe shell, and has a cylindrical surface slidably fitted to an inner peripheral surface of an outer pipe shell. In such double exhaust pipe, a drop in temperature of an exhaust gas flowing through the inner pipe shell can be prevented by the presence of the heat-insulating space between the inner and outer pipe shells, thereby enhancing the exhaust emission control function of an exhaust emission control device connected to a downstream portion of the double exhaust pipe. In this case, a thermal elongation of the inner pipe shell is absorbed by slipping the bulged portion at the other end, i.e., the free end of the inner pipe shell on the inner peripheral surface of the outer pipe shell.

However, the double exhaust pipe for the engine generally has a bent portion. For this reason, when the inner pipe shell is thermally elongated, one end and the other end of the inner pipe shell are thermally elongated in different directions. Due to this, the bent portion is further bent and hence, an inclination occurs on the side of the free end of the inner pipe shell. When the free end side is inclined, an end edge of the bulged portion of the free end bites the inner peripheral surface of the outer pipe shell to increase the sliding resistance to the outer pipe shell, whereby an excessively large thermal strain is generated in the inner and outer pipe shells, or a failure of contact occurs between a portion of the bulged portion and the inner peripheral surface of the outer pipe shell to generate a chattering sound or vibration sound. The foregoing has been found by the present inventors.

SUMMARY OF THE INVENTION

Accordingly, the present invention has been proposed based on the mentioned finding and it is an object of the present invention to provide a double exhaust pipe for en engine, wherein even if the free end is inclined upon the thermal elongation of the inner pipe shell, no failure of contact occurs between the bulged portion at the free end and the inner peripheral surface of the outer pipe shell and hence, the bulged portion can always be smoothly slipped on the inner peripheral surface of the outer pipe shell.

To achieve the above object, according to a first aspect and feature of the present invention, there is provided a double exhaust pipe for an engine, comprising an inner pipe shell, an outer pipe shell in which the inner pipe shell is accommodated, the inner pipe shell being secured at one end thereof to the outer pipe shell and slidably fitted at the other end thereof to an inner peripheral surface of the outer pipe shell, and a heat-insulating space provided between the inner and outer pipe shells to extend from the one end to the other end of the inner pipe shell, wherein the inner pipe shell has a bulged portion formed at the other end thereof, the bulged portion having a spherical outer surface slidably and oscillatably fitted to an inner peripheral surface of the outer pipe shell.

With the first feature, when the other end, i.e., the free end of the inner pipe shell is inclined upon thermal elongation of the inner pipe shell, the bulged portion at the other end thereof is oscillated with little resistance in response to such inclination, and the state of the bulged portion fitted to the outer pipe shell is maintained constant. Therefore, the slipping of the bulged portion on the inner peripheral surface of the outer pipe shell is not impeded, and the generation of a thermal strain in the inner and outer pipe shells can be inhibited effectively. No failure of the pressure contact of the bulged portion with the inner peripheral surface of the outer pipe shell can be brought about and hence, the generation of a chattering sound or vibration sound can be also prevented.

According to a second aspect and feature of the present invention, in addition to the first feature, the bulged portion is comprised of three or more crests arranged in a circumferential direction of the inner pipe shell with valleys which are interposed between adjacent ones of the crests and spaced from the inner peripheral surface of the outer pipe shell.

With the second feature, the contact of the entire periphery of the bulged portion of the inner pipe shell with the outer pipe shell can be avoided, while ensuring the concentricity of the bulged portion and the outer pipe shell, thereby inhibiting the heat transfer from the inner pipe shell to the outer pipe shell to the utmost.

According to a third aspect and feature, in addition to the first or second feature, wherein each of the crests has a radius of curvature of an outer surface thereof in the circumferential direction of the inner pipe shell determined smaller than an inside diameter of the outer pipe shell.

With the third feature, the bulged portion of the inner pipe shell can be brought into generally point contact with the outer pipe shell, thereby effectively inhibiting the heat transfer from the inner pipe shell to the outer pipe shell.

According to a fourth aspect and feature of the present invention, there is provided an exhaust manifold for an engine, comprising a plurality of exhaust pipe branches each formed of the double exhaust pipe according to any of the first to third features.

With the fourth feature, it is possible to provide an exhaust manifold which has a high heat-retaining property and in which a thermal strain is little produced.

The above and other objects, features and advantages of the invention will become apparent from the following description of the preferred embodiments taken in conjunction with the accompanying drawings.

DESCRIPTION OF THE PREFERRED EMBODIMENTS

The present invention will now be described by way of an embodiment with reference to the accompanying drawings.

Figure 1:
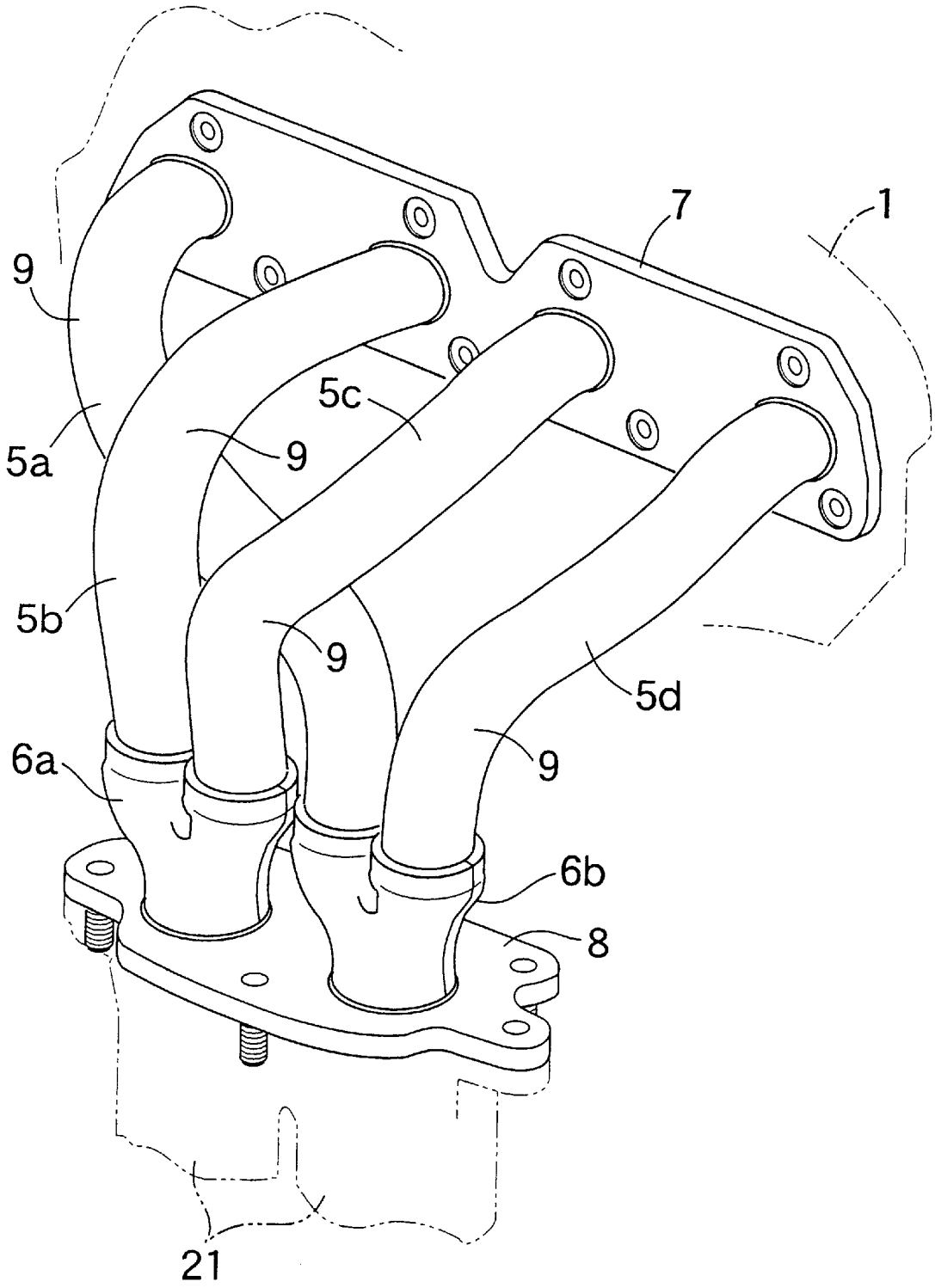
FIG. 1 is a perspective view of an exhaust manifold according to a first embodiment of the present invention.
Figure 2:
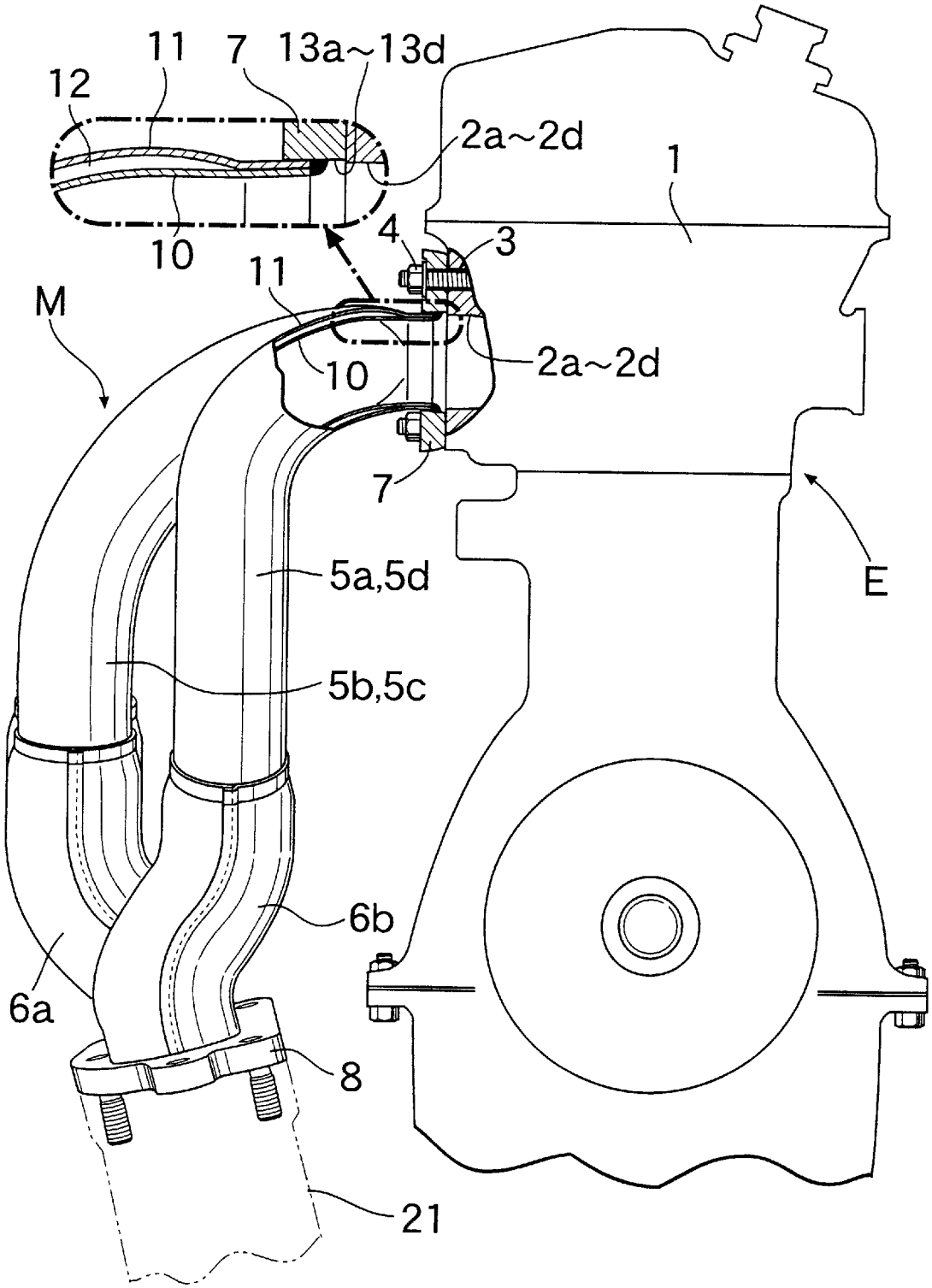
FIG. 2 is a side view of the exhaust manifold mounted in an engine for an automobile.

A first embodiment of the present invention will be first described with reference to FIGS. 1 to 4. Referring first to FIGS. 1 and 2, four exhaust ports 2*a*, 2*b*, 2*c* and 2*d* open into a front surface of a cylinder head 1 of a 4-cylinder engine E in correspondence to the cylinders, and an exhaust manifold M is mounted to the cylinder head 1 by a plurality of stud bolts 3 and nuts 4 for guiding an exhaust gas discharged from the exhaust ports 2*a*, 2*b*, 2*c* and 2*d*.

The exhaust manifold M includes four exhaust pipe branches 5*a*, 5*b*, 5*c* and 5*d* individually communicating with the four exhaust ports 2*a*, 2*b*, 2*c* and 2*d*, and will be called first, second, third and fourth pipe braches in the named order from the left side in FIG. 1.

An upper flange 7 is connected to upstream ends of the first, second, third and fourth exhaust pipe branches 5*a*, 5*b*, 5*c* and 5*d*. A first exhaust-gas collection pipe 6*a* is connected to downstream ends of the second and third exhaust pipe branches 5*b* and 5*c*, and a second exhaust-gas collection pipe 6*b* is connected to downstream ends of the first and fourth exhaust pipe branches 5*a* and 5*d*. A lower flange 8 is connected to downstream ends of the first and second exhaust-gas collection pipes 6*a* and 6*b*. The upper flange 7 is secured to the cylinder head 1 by the stud bolts 3 and the nuts 4, and an intermediate exhaust pipe 21 connected to a common catalytic converter, i.e., an exhaust emission control device (not shown) disposed under a floor of a vehicle. The upper and lower flanges 7 and 8 are disposed at orientations turned through approximately 90°, whereby the first, second, third and fourth exhaust pipe branches 5*a*, 5*b*, 5*c* and 5*d* are bent moderately at their intermediate portions 9.

Each of the exhaust pipe branches 5*a*, 5*b*, 5*c* and 5*d* is formed of a double exhaust pipe according to the present invention, which is comprised of an inner pipe shell 10 and an outer pipe shell 11 which are doubly disposed on inner and outer sides. A cylindrical heat-insulating space 12 is defined between the inner and outer pipe shells 10 and 11. The inner pipe shell 10 is made of a thin stainless steel, and the outer pipe shell 11 is also made of a stainless steel, but thicker than the inner pipe shell 10.

The outer pipe shell 11 has an upstream end which is reduced in diameter, so that it is fitted over an outer peripheral surface of an upstream end of the inner pipe shell 10. The upstream ends of the inner and outer pipe shells 10 and 11 are fitted into through-bores 13*a*, 13*b*, 13*c* and 13*d* defined in the upper flange 7 and connected to the corresponding exhaust ports 2*a*, 2*b*, 2*c* and 2*d*, and are secured by welding to inner peripheral surfaces of the through-bores 13*a*, 13*b*, 13*c* and 13*d* (see FIG. 2).

Figure 3:
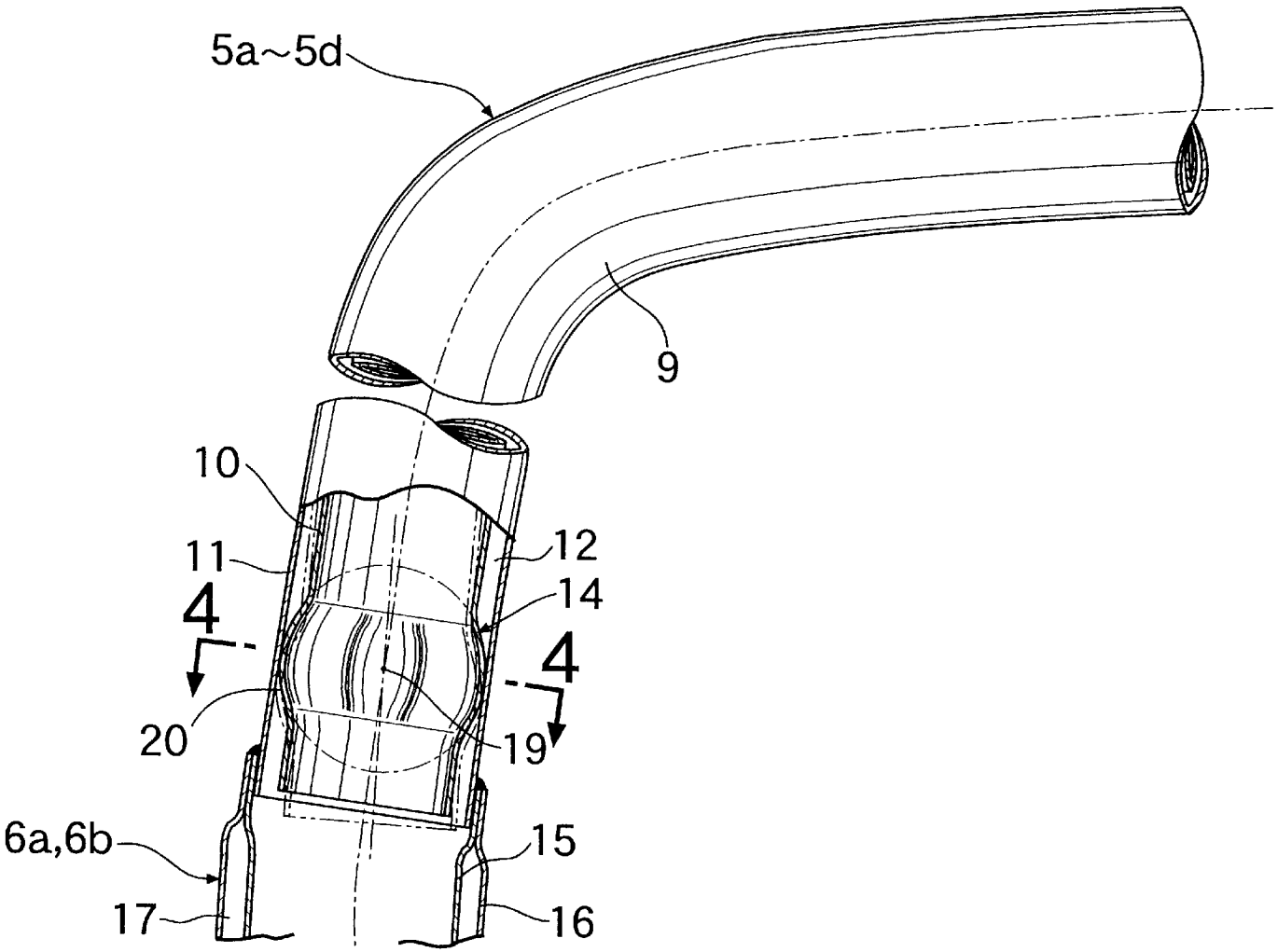
FIG. 3 is an enlarged vertical sectional view of an essential portion shown in FIG. 2.
Figure 4:
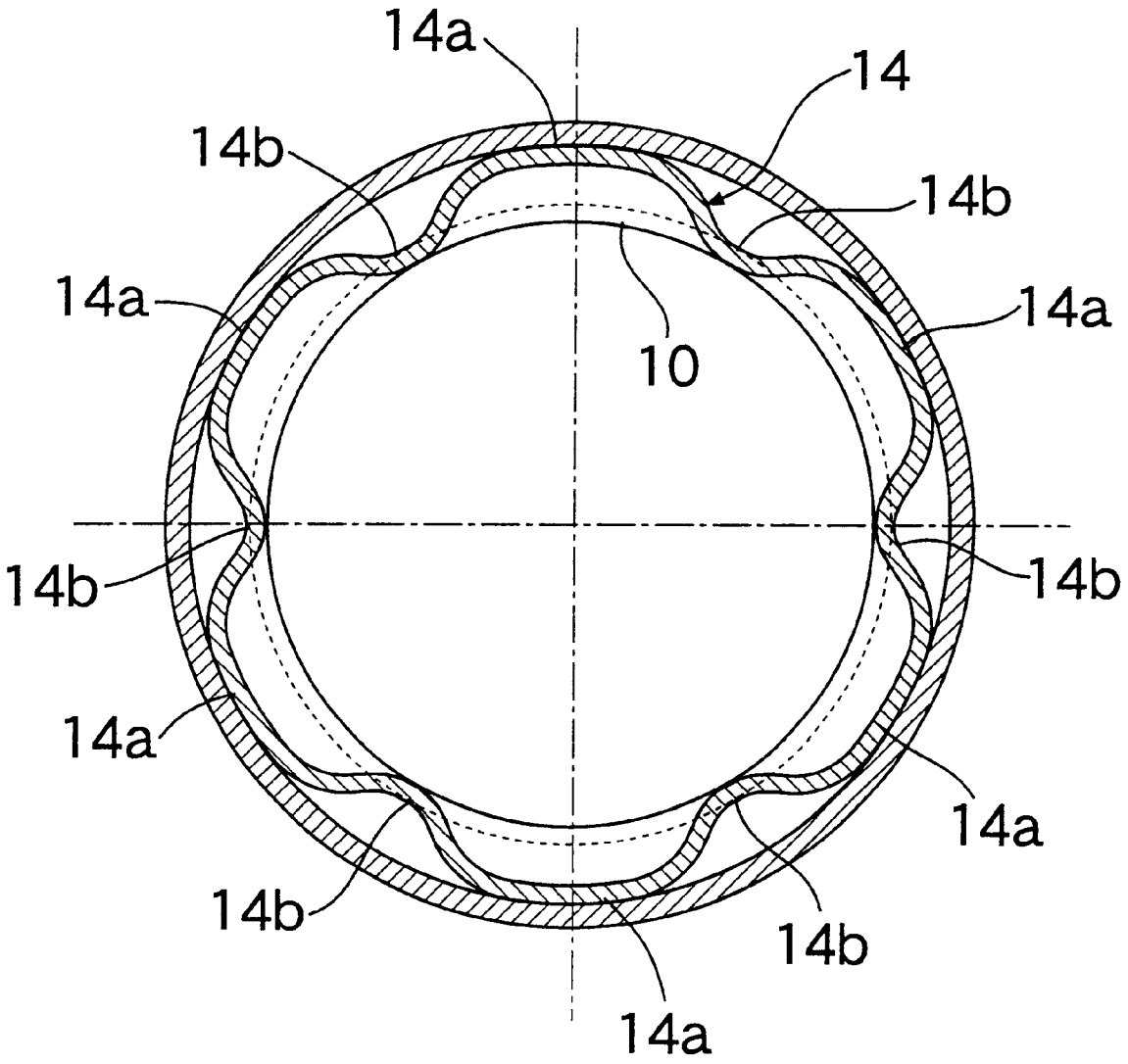
FIG. 4 is a sectional view taken along a line 4—4 in FIG. 3.

As shown in FIGS. 3 and 4, a bulged portion 14 is formed at the downstream end of the inner pipe shell 10 by increasing the diameter of the inner periphery of the inner pipe shell 10, which protrudes from an inner peripheral surface to an outer peripheral surface of the inner pipe shell 10. The bulged portion 14 is slidably fitted to the inner peripheral surface of the outer pipe shell 11 with a predetermined pressure-contact force. Thus, the downstream end of the inner pipe shell 10 is slidably carried on the inner peripheral surface of the outer pipe shell 11.

The bulged portion 14 has a spherical outer surface 20 having a center 19 on an axis of the inner pipe shell 10. The bulged portion 14 is comprised of three or more (six in the illustrated embodiment) crests 14*a* arranged in a circumferential direction of the inner pipe shell 10 with valleys 14*b* interposed between the adjacent crests 14*a* and spaced from the inner peripheral surface of the outer pipe shell 11.

Each of the exhaust-gas collection pipes 6*a* and 6*b* is comprised of inner and outer pipe shells 15 and 16 doubly disposed on inner and outer sides, and a heat-insulating space 17 is also provided between the inner and outer pipe shells 15 and 16.

The operation of the first embodiment will be described below.

During operation of the engine E, an exhaust gas is discharged from the four exhaust ports 2*a*, 2*b*, 2*c* and 2*d* sequentially into the first, second, third and fourth exhaust pipe branches 5*a*, 5*b*, 5*c* and 5*d*. Then, the exhaust gas flowing through the first exhaust pipe branch 5*a* and the exhaust gas flowing through the fourth exhaust pipe branch 5*d* are joined together in the second exhaust-gas connection pipe 6*b*. Then exhaust gas flowing through the second exhaust pipe branch 5*b* and the exhaust gas flowing through the third exhaust pipe branch 5*c* are joined together in the first exhaust-gas connection pie 6*a*. Thereafter, the exhaust gas flows are joined together in the intermediate exhaust pipe 21 and then guided to the common catalytic converter (not shown), where the exhaust gas is purified.

Each of the exhaust pipe branches 5*a*, 5*b*, 5*c* and 5*d* is comprised of the inner and outer pipe shells 10 and 11 doubly disposed on the inner and outer sides, the inner pipe shell 10 being formed at a smaller thickness, and the heat-insulating space 12 is defined between the inner and outer pipe shells 10 and 11. Therefore, the inner pipe shell 10 having a smaller heat mass is heated and raised in temperature quickly by the exhaust gas having a high temperature and flowing through the inside of the inner pipe shell 10, whereby it is kept warm by the heat-insulating space 12. Therefore, the succeeding exhaust gas is guided to the catalytic converter with a reduction in its temperature inhibited, thereby promoting the activation of the catalytic converter to enhance the exhaust emission control efficiency.

During this time, an axially thermal elongation occurs in each of the exhaust pipe branches 5*a*, 5*b*, 5*c* and 5*d* to such an extent that it is larger in the inner pipe shell 10 than in the outer pipe shell 11. As a result of such elongation, the bulged portion 14 is slipped on the inner peripheral surface of the outer pipe shell 11 supporting the bulged portion 14, whereby a difference between the axial thermal elongations of the inner and outer pipe shells 10 and 11 is absorbed.

The intermediate portions of the exhaust pipe branches 5*a*, 5*b*, 5*c* and 5*d* are bent in various directions. Therefore, when each of the inner pipe shells 10 is thermally elongated larger than the corresponding outer pipe shell 11, the bent portion 9 is further bent due to a difference between directions of thermal elongation of the upstream and downstream portions of the inner pipe shell 10, while making the bent portion 9 as a border of the difference, as shown by dashed lines in FIG. 3, whereby the downstream portion of the inner pipe shell 10 is inclined relative to the outer pipe shell 11. However, the bulged portion 14 around the outer periphery of the downstream end of the inner pipe shell 10 has the spherical outer surface 20 fitted to the inner peripheral surface of the outer pipe shell 11 and hence, the bulged portion 14 is oscillated with little resistance in response to the inclination of the downstream portion of the inner pipe shell 10 and moreover, the state of fitted pressure-contact of the bulged portion 14 with the outer pipe shell 11 is maintained constant. Therefore, the slipping of the bulged portion 14 on the inner peripheral surface of the outer pipe shell 11 is not impeded, and the generation of a thermal strain in the inner and outer pipe shells 10 and 11 can be inhibited effectively. A failure of the pressure contact of the bulged portion 14 with the inner peripheral surface of the outer pipe shell 11 cannot be brought about and hence, the generation of a chattering sound or vibration sound can be also prevented previously.

Further, the bulged portion 14 is comprised of the three or more (six in the illustrated embodiment) crests 14*a* arranged in the circumferential direction of the inner pipe shell 10, with the valleys 14*b* interposed between the adjacent crests 14*a* and spaced from the inner peripheral surface of the outer pipe shell 11. Therefore, the contact areas of the bulged portion 14 with the outer pipe shell 11 are limited to tops of the three or more crests 14*a*. Thus, the contact of the entire periphery of the bulged portion 14 with the inner peripheral surface of the outer pipe shell 11 can be avoided, and the concentricity of the bulged portion 14 and the outer pipe shell 11 can be stabilized, while inhibiting the heat transfer from the bulged portion 14 to the outer pipe shell 11 to the utmost.

Figure 5:
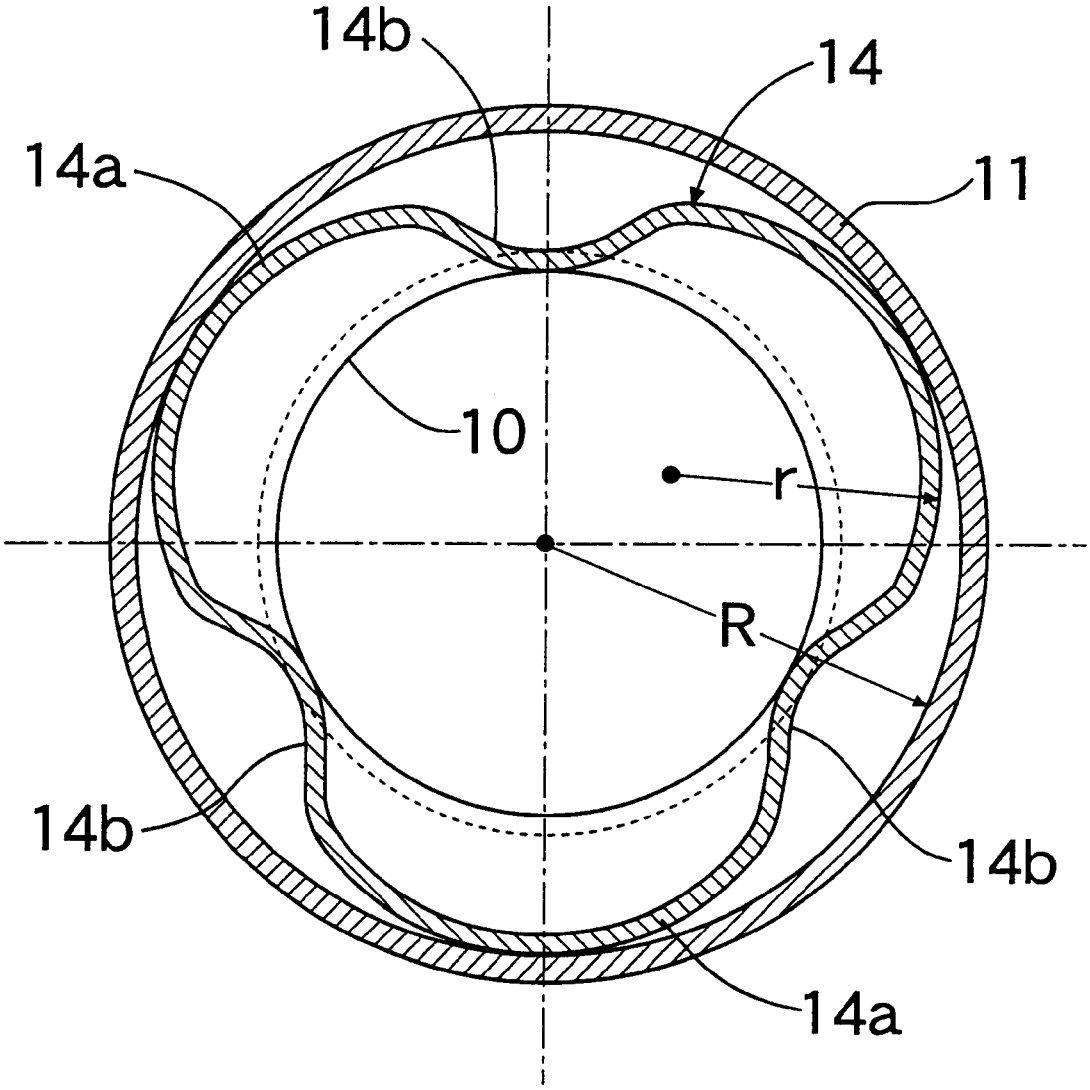
FIG. 5 is a sectional view similar to FIG. 4, but according to a second embodiment of the present invention.

FIG. 5 shows a second embodiment of the present invention. The second embodiment is of an arrangement similar to that of the first embodiment, except that a bulged portion 14 at a downstream end of an inner pipe shell 10 is comprised of three crests 14*a* arranged circumferentially, with a radius of curvature of an outer surface of each of the crests 14*a* in the circumferential direction of the inner pipe shell 10 being smaller than an inside diameter R of an outer pipe shell 11. In FIG. 5, portions or components corresponding to those in the first embodiment are designated by like reference characters, and the description of them is omitted.

The state of generally point contact of the outer peripheral surface of the bulged portion 14 with the inner peripheral surface of the outer pipe shell 11 is maintained at any oscillated position of the bulged portion 14, and the heat transfer from the bulged portion 14 to the outer pipe shell 11, while maintaining the concentricity of the bulged portion 14 and the outer pipe shell 11.

Although the embodiments of the present invention have been described in detail, it will be understood that the present invention is not limited to the above-described embodiments, and various modifications in design may be made without departing from the spirit and scope of the invention defined in claims.

For example, the required number of the crests forming the bulged portion 14 is at least three for the purpose of providing the concentricity of the bulged portion 14 and the outer pipe shell 11 and hence, three or more crests may be provided. The double exhaust pipe according to the present invention is also applicable to an exhaust pipe for an engine of a motorcycle.

What is claimed is:

1. A double exhaust pipe for an engine, said double exhaust pipe having a bent portion at an intermediate portion thereof and comprising an inner pipe shell, and an outer pipe shell in which said inner pipe shell is accommodated, said inner pipe shell being secured at one end thereof to said outer pipe shell and slidably fitted at the other end thereof to an inner peripheral surface of said outer pipe shell, and a heat-insulating space provided between said inner and outer pipe shells to extend from said one end to the other end of said inner pipe shell, wherein said inner pipe shell has a bulged portion formed at the other end thereof, said bulged portion having a spherical outer surface slidably and oscillatably fitted to an inner peripheral surface of said outer pipe shell.

2. An exhaust manifold for an engine, comprising a plurality of exhaust pipe branches each formed of the double exhaust pipe according to claim 1.

3. A double exhaust pipe for an engine said double exhaust pipe having a bent portion at an intermediate portion thereof and comprising an inner pipe shell, and an outer pipe shell in which said inner pipe shell is accommodated, said inner pipe shell being secured at one end thereof to said outer pipe shell and slidably fitted at the other end thereof to an inner peripheral surface of said outer pipe shell, and a heat-insulating space provided between said inner and outer pipe shells to extend from said one end to the other end of said inner pipe shell, wherein said inner pipe shell has a bulged portion formed at the other end thereof, said bulged portion having a spherical outer surface slidably and oscillatably fitted to an inner peripheral surface of said outer pipe shell, and further comprises bulged portion of three or more crests arranged in a circumferential direction of said inner pipe shell with valleys which are interposed between adjacent ones of said crests and spaced from the inner peripheral surface of said outer pipe shell.

4. A double exhaust pipe for an engine according to claim 2, wherein each of said crests has a radius of curvature of an outer surface thereof in the circumferential direction of said inner pipe shell determined smaller than an inside diameter of said outer pipe shell.

5. An exhaust manifold for an engine, comprising a plurality of exhaust pipe branches each formed of the double exhaust pipe according to claim 3.

6. An exhaust manifold for an engine, comprising a plurality of exhaust pipe branches each formed of the double exhaust pipe according to claim 4.

* * * * *